US005616155A

United States Patent [19]

Kronzer

[11] Patent Number: 5,616,155

[45] Date of Patent: Apr. 1, 1997

[54] COATED FABRIC SUITABLE FOR PREPARING RELEASABLY ATTACHABLE ABRASIVE SHEET MATERIAL

[75] Inventor: Francis J. Kronzer, Marietta, Ga.

[73] Assignee: Kimberly-Clark Corporation, Neenah, Wis.

[21] Appl. No.: 452,460

[22] Filed: May 26, 1995

Related U.S. Application Data

[62] Division of Ser. No. 151,228, Nov. 12, 1993, abandoned.

[51] Int. Cl.[6] ..... B24B 1/00

[52] U.S. Cl. ..... 51/295; 51/247; 428/100; 442/62; 442/73

[58] Field of Search ..... 428/100, 87, 143, 428/253, 254, 283, 343; 427/202, 204, 412; 51/295, 297; 156/153, 154

[56] References Cited

U.S. PATENT DOCUMENTS

| | | | |
|---|---|---|---|
| 2,717,437 | 9/1955 | De Mestral | 28/72 |
| 3,083,737 | 4/1963 | De Mestral | 139/46 |
| 3,114,951 | 12/1963 | De Mestral | 24/204 |
| 3,154,837 | 11/1964 | De Mestral | 28/72 |
| 3,748,701 | 7/1973 | De Mestral | 24/204 |
| 4,677,011 | 6/1987 | Matsuda | 428/88 |
| 4,725,487 | 2/1988 | Pemrich et al. | 428/253 |
| 4,857,379 | 8/1989 | Plontges et al. | 428/102 |
| 4,931,343 | 6/1990 | Becker et al. | 428/95 |
| 5,176,074 | 1/1993 | Hartmann | 100/116 |

FOREIGN PATENT DOCUMENTS

| | | | |
|---|---|---|---|
| 0198713 | 10/1986 | European Pat. Off. | B24D 11/02 |
| 0239126 | 9/1987 | European Pat. Off. | B24D 11/02 |
| 0578865 | 1/1994 | European Pat. Off. | B24D 3/00 |
| 3219344 | 11/1983 | Germany | B24D 9/08 |
| 3903204 | 2/1990 | Germany | B24D 11/02 |
| 2056332 | 11/1982 | United Kingdom . | |

*Primary Examiner*—James J. Bell
*Attorney, Agent, or Firm*—William E. Maycock

[57] ABSTRACT

A coated fabric having a first surface engagable by hooks and a second surface having thereon a continuous coating of a synthetic polymeric composition. An example of a surface engagable by hooks is a surface having a plurality of loops. The fabric is especially suitable for use in the preparation of a releasably attachable abrasive sheet material. The continuous coating of synthetic polymeric material typically is applied by melt extrusion.

6 Claims, No Drawings

COATED FABRIC SUITABLE FOR PREPARING RELEASABLY ATTACHABLE ABRASIVE SHEET MATERIAL

This application is a division of U.S. Ser. No. 08/151,228 entitled "COATED FABRIC SUITABLE FOR PREPARING RELEASABLY ATTACHABLE ABRASIVE SHEET MATERIAL" and filed in the U.S. Patent and Trademark Office on Nov. 12, 1993, now abandoned.

BACKGROUND OF THE INVENTION

The present invention relates to a coated fabric.

Abrasive sheet materials are widely used for a variety of applications, and include, by way of illustration only, sandpapers, emery cloths, sanding discs for rotary sanders, and sanding strips for orbital and belt sanders. By utilizing very fine abrasive materials, abrasive sheet materials also can be used for polishing operations. Abrasive sheet materials most often comprise a layer of an abrasive, or abrasive particles or grit, which is attached to a paper base of varying thickness by means of an adhesive.

In some instances, the abrasive sheet material is used by itself or wrapped by hand around a block or pad. In other instances, the abrasive sheet material is attached at distal ends by mechanical means to a motorized sanding tool having a disc or pad. Because of the rapid movement of such a motorized sanding tool, the unattached edges of the abrasive sheet material are easily damaged or torn. It is, therefore, desirable that the abrasive sheet material is substantially completely attachable to the disc or pad of the sanding tool. For many applications, the abrasive sheet materials need to be readily exchanged for other sheets, either to replace worn-out sheets or to change to a finer or coarser grit.

Abrasive sheet materials which are substantially completely attachable to and readily removable from a sanding tool are known. In some embodiments, these materials are attached by a pressure-sensitive adhesive. In other embodiments, they include a looped fabric having a paper sheet attached to the back thereof by an adhesive. The free surface of the paper has an abrasive attached thereto by means of an adhesive. The looped fabric is attachable to a hook-type attachment means well known to those in the art.

Abrasive sheet materials based on a hook-and-loop attachment mechanism have several advantages over abrasive sheet materials which are attached to a sanding tool by means of a pressure-sensitive adhesive. For example, the former, unlike pressure-sensitive adhesive types, remain firmly attached even when heated or cooled excessively. In addition, they are easily and cleanly removed after use. However, because they are made from two separate layers which have been laminated together, they are costly to manufacture. Moreover, delamination can occur, particularly under conditions of high stress or temperature.

SUMMARY OF THE INVENTION

It is an object of the present invention to provide a coated fabric.

It is another object of the present invention to provide a releasably attachable abrasive sheet material which utilizes such coated fabric.

These and other objects will be apparent to one having ordinary skill in the art from a consideration of the specification and claims which follow.

Accordingly, the present invention provides a coated fabric having a first surface engagable by hooks and a second surface having bonded thereto a continuous coating of a synthetic polymeric composition.

The present invention also provides a releasably attachable abrasive sheet material which includes a fabric having a first surface engagable by hooks and a second surface, a continuous coating of a synthetic polymeric composition bonded to the second surface, and a layer of abrasive particles bonded to the continuous coating of synthetic polymeric material.

The present invention further provides a method of making a coated fabric which includes providing a fabric having a first surface engagable by hooks and a second surface, and applying to the second surface a synthetic polymeric composition to form a continuous coating.

The present invention additionally provides a method of making a releasably attachable abrasive sheet material which includes providing a fabric having a first surface engagable by hooks and a second surface, applying to the second surface of the fabric a synthetic polymeric composition to form a continuous coating, applying a layer of adhesive over the coating of synthetic polymeric composition, and distributing a layer of abrasive particles over the layer of adhesive.

In certain embodiments, the fabric is a knitted fabric. In other embodiments, the first surface of the fabric has a plurality of loops. In further embodiments, the fabric is prepared from a multifilament yarn. In yet other embodiments, the synthetic polymeric composition is applied to the second surface of the fabric by a melt-extrusion process.

DETAILED DESCRIPTION OF THE INVENTION

The phrase "fabric having a first surface engagable by hooks and a second surface" is intended to generally encompass all of the well-known fabrics adapted to be used with a hook-and-loop type fastening system, such as the VELCRO® releasable fastening systems which presently are so common. For convenience, such fabric often is referred to herein simply as "the fabric." The term "looped fabric" and the phrase "plurality of loops" as applied to the first surface of the fabric are used synonymously to mean any of the fabrics constructed with loops of some type on a surface thereof which are engaged by hooks or their equivalent. However, the term "hooks" is used broadly herein to encompass hooks per se and all equivalent structures, e.g., hook-type and mushroom-type structures and the like.

The material from which the fabric having a first surface engagable by hooks and a second surface is constructed and the manner of its construction are well known to those having ordinary skill in the art. In some embodiments involving a looped fabric, the looped fabric will be a knitted fabric which has been processed, or "teased", to form the loops. Knitted fabrics frequently are manufactured from multifilament yarns made from, for example, poly(ethylene terephthalate). The fabric may be formed in a wide variety of basis weights, although lighter weight fabrics provide some economics in manufacturing and can reduce lateral deformation during use. The lighter weight fabrics in particular have an open structure which is more mesh-like than fabric-like in appearance. In certain embodiments, the fabric will have a basis weight in the range of from about 20 to about 120 grams per square meter ($g/m^2$). For example, fabrics intended for light-duty applications may have a basis weight in the range of from about 20 to about 80 g/m$^2$, while fabrics intended for heavy-duty applications may have a basis weight in the range of from about 80 to about 120 g/m$^2$. However, fabrics having a basis weight lighter than about 20 g/m$^2$ or heavier than about 120 g/m$^2$ can be employed, if desired.

As already noted, the fabric has a first surface engagable by hooks, e.g., having a plurality of loops, and a second surface. The second surface is what normally is considered to be the back surface and is the surface which is coated with the synthetic polymeric composition. The resulting continuous coating provides a nonporous surface to which abrasive particles can be attached, typically by means of an adhesive coating or layer. The continuous coating also binds the fabric together, giving it resistance to mechanical distortion during conversion of the coated fabric to an abrasive sheet material and during use of the resulting abrasive sheet material.

Any conventional synthetic polymeric composition may be utilized so long as the composition adheres or bonds well to the second or back surface of the fabric and is compatible with the particular adhesive which may be used to attach the adhesive particles to the coated surface of the fabric. Suitable polymeric compositions include, by way of illustration only, polyolefins, especially polyethylene and copolymers of ethylene and one or more of such monomers as vinyl acetate, acrylic acid, methacrylic acid, acrylic acid esters (acrylates), and methacrylic acid esters (methacrylates); copolymers of ethylene with such vinyl monomers as vinyl alcohol, vinyl chloride, and vinylidene chloride; polystyrene and copolymers of styrene with butadiene and acrylonitrile; acrylonitrile-butadiene-styrene terpolymers; polyamides; polyesters, including both homopolymers and copolymers; polyurethanes; and polyether esters. The synthetic polymeric composition can be a thermoplastic material or a thermosetting material.

The thickness of the coating required will vary according to the intended use for the coated fabric. For example, thicker coatings normally will be required for coarse grit abrasive products, e.g., abrasives having particle sizes of 200 mesh or greater (the term "mesh" is used herein to mean U.S. Standard Sieve mesh). On the other hand, thinner coatings may be used for finer grit products which are to be used for polishing on fine surface finishing. A practical minimum coating thickness is about 1 mil (about 25 micrometers), whereas the practical maximum thickness is about 10 mils (about 250 micrometers). However, thinner or thicker coatings can be employed, if desired, provided that the coating is continuous. Thermoplastic polymeric compositions which are inherently stiff will be more useful for coarse grit products, while softer or elastomeric thermoplastic polymeric compositions like ethylene-vinyl acetate copolymers and polyurethanes will be more useful for such fine grit products as fine sanding and polishing cloths.

The continuous coating of the synthetic polymeric composition can be a single layer or two or more layers. If two or more layers are employed, the various layers can be the same or different. That is, the same polymeric composition can be employed for every layer or a different composition can be employed for each layer. Although usually not required, a layer of adhesive or other material can, in some embodiments, be interposed between the second surface of the fabric and the continuous coating of synthetic polymeric composition.

Any of the known types of adhesives can be used to bond the abrasive particles to the coating of synthetic polymeric composition. For example, the adhesive may be thermosetting adhesive, such as, by way of illustration only, epoxy resins, phenolics, polyurethanes, polyesters, and alkyds. Water-based dispersions such as an ammonia-dispersed ethylene-vinyl acetate copolymer also can be employed. The selection of adhesive typically is dictated by the end use, but the adhesive must be compatible with the synthetic polymeric coating over which it is applied. Phenolics are most useful for very tough, coarse abrasive products for rough finishing or shaping, especially where the product needs to be waterproof as well. More flexible adhesives such as epoxy resins and alkyds are also waterproof and are desirable for fine-finishing products.

In general, any of the commonly employed abrasive materials known to those having ordinary skill in the art can be used. Such materials can vary from very coarse to very fine. Exemplary abrasive materials include silicon carbide, aluminum oxide, garnet, and diamond, by way of illustration only.

If desired, one or more layers of an adhesive or other material can be formed over the layer of abrasive particles. Such a layer can serve to better anchor all of the abrasive particles to the abrasive sheet material, thereby reducing abrasive loss during use and increasing the life of the abrasive sheet material.

The synthetic polymeric composition can be applied neat, as a solution in a suitable solvent, or as a dispersion in water or other liquid by methods well known to those having ordinary skill in the art. In some embodiments, processes which apply a viscous, high solids content fluid to the surface of a sheet material are utilized. Such processes can utilize 100 percent solids compositions which include, by way of illustration only, ultraviolet radiation curable acrylics and liquid epoxy thermosets. Such compositions can be applied with, for example, slot die coaters and knife-over-roll coaters. In addition, thermoplastic powder coating methods can be employed, such as electrostatic coating methods. In other embodiments, processes such as hot melt coating and melt extrusion which apply a molten composition directly to the fabric are employed, particularly where the fabric is exceptionally porous and open in nature. If desired, the synthetic polymeric composition can be preformed into, for example, a film which then can be bonded to the second surface of the fabric by heat or an adhesive layer.

Any generally accepted means of applying adhesive to a sheet material can be employed, including such methods as roll, reverse roll, gravure, and Meyer rod coating. It generally is desirable to avoid placing the fabric under significant tension in order to minimize fabric distortion, especially when the adhesive is being heat cured. Curing temperatures desirably will be kept below about 125° C., as higher temperatures also tend to distort the fabric.

The present invention is further described by the examples which follow. Such examples, however, are not to be construed as limiting in any way either the spirit or the scope of the present invention. In the examples, all parts are by weight, unless stated otherwise.

EXAMPLE 1

The fabric employed was a knitted loop material from Guilford Mills Inc., Greensboro, N.C. The fabric had a basis weight of 50 g/m$^2$ and a very open structure. A sample of the fabric was coated on a coextrusion coater. The first layer, which was adjacent to and contiguous with the second or back surface of the fabric, was approximately 1 mil (about 25 micrometers) thick and consisted of an ethylene-vinylacetate copolymer (Elvax 3200, DuPont Company, Polymer Products, Packaging Products Division, Wilmington, Del.). The second layer, which was coextruded over the first layer, was about 0.5 mil (about 13 micrometers) thick and consisted of an ionomer resin (Suryln 1702, DuPont Company, Polymer Products, Packaging Products Division, Wilmington, Del.). The coated fabric was identified as Sample A.

A 3-mil (about 76-micrometer) thick film of high density polyethylene which had been corona treated on one side was bonded, in a heated laboratory press, to the second or back surface of another sample of the fabric (Sample B); the surface of the film which had not been corona treated was placed next to the back surface of the looped fabric sample. The lever-operated press was closed by hand and heated at a temperature of about 150° C. Pressure was maintained for about one minute, which was not long enough to cause heat distortion of the fabric. The coated fabric was identified as Sample B; based on handling characteristics, it appeared to be stronger and stiffer than Sample A.

Each sample was coated with an adhesive which consisted of an epoxy resin (Epon 828, Shell Chemical Company, Houston, Tex.) which contained 4 percent by weight of 2-methylimidazole as a curing agent. The adhesive was dissolved to 62 percent by weight solids in a solvent mixture consisting of 100 parts by volume of methyl ethyl ketone and 30 parts by volume of isopropanol. The adhesive solution was applied over the coating on the looped fabric with a No. 20 Meyer rod. Silicon carbide grit, No. 180 (Supreme Felt and Abrasive Co., Melrose Park, Ill.), was distributed over the wet adhesive by hand. The adhesive was cured for 30 minutes at about 107° C. The same adhesive then was top-coated over the grit layer by means of a No. 4 Meyer rod and cured for two hours at about 107° C.

Both samples were attached to a VELCRO® sanding pad and used to abrade metal and wood. Neither sample appeared to soften appreciably when wet and both samples could be used for wet metal sanding.

EXAMPLE 2

The procedure of Example 1, was repeated, except that the second surface of a sample of the fabric was separately extrusion coated to an approximate thickness of 3 mils (about 76 micrometers) with each of three additional synthetic polymeric compositions (Samples C, D, and E, respectively).

The synthetic polymeric composition employed in the preparation of Sample C was an ethylene-propylene elastomer (KSO 84P, Himont USA, Wilmington, Del.). The composition coated and bonded well, and appeared to give a flexible and tough coating.

In the case of Sample D, the synthetic polymeric composition was a polyether-ester elastomer (Arnitel EM400, Akzo Engineering Plastic, Inc., Evansville, Ind.). The resulting coated fabric appeared to be similar to those of Sample C.

The coating for Sample E employed an impact-modified polystyrene (Styron 478, Dow Plastics, Midland, Mich.). The synthetic polymeric composition coated well to give a stiff coated fabric. However, adhesion to the fabric appeared to be poor. Adhesion was improved by heating the coated fabric in a heated laboratory press for two minutes at about 166° C.

Having thus described the invention, numerous changes and modifications thereof will be readily apparent to those having ordinary skill in the art without departing from the spirit or scope of the invention.

What is claimed is:

1. A releasably attachable abrasive sheet material which consists of:

a fabric having a first surface engagable by hooks and a second surface, wherein the first surface is engagable by hooks as a consequence of the construction of the fabric;

a continuous coating of a synthetic polymeric composition bonded to said second surface; and a layer of abrasive particles bonded to said coating of synthetic polymeric composition.

2. The releasably attachable abrasive sheet material of claim 1, in which said fabric is a knitted fabric.

3. The releasably attachable abrasive sheet material of claim 2, in which said first surface of said fabric has a plurality of loops.

4. The releasably attachable abrasive sheet material of claim 3, in which said fabric is made from a multifilament yarn.

5. The releasably attachable abrasive sheet material of claim 1, in which said layer of abrasive particles is bonded to said coating of synthetic polymeric composition by means of a layer of an adhesive.

6. The releasably attachable abrasive sheet material of claim 1, in which said layer of abrasive particles is coated with a layer of an adhesive.

* * * * *